US005379823A

United States Patent [19]

Kraeutler

[11] Patent Number: 5,379,823

[45] Date of Patent: Jan. 10, 1995

[54] RAISABLE-CURTAIN DOOR PROVIDING LOW HEAT LOSS

[75] Inventor: Bernard Kraeutler, Dunieres, France

[73] Assignee: Nergeco, Dunieres, France

[21] Appl. No.: 967,117

[22] Filed: Oct. 27, 1992

[30] Foreign Application Priority Data

Oct. 30, 1991 [FR] France ..... 91 13435

[51] Int. Cl.[6] ..... E06B 9/17

[52] U.S. Cl. ..... 160/271; 160/84.06

[58] Field of Search ..... 160/271, 133, 273.1, 160/264, 268.1, 270, 272, 267.1, 266, 84.1 E, 172, 201, 207; 16/87 R, 94 R, 95 R, 96 R

[56] References Cited

U.S. PATENT DOCUMENTS

| | | | |
|---|---|---|---|
| 2,407,784 | 9/1946 | Hoffstad | 160/273.1 |
| 3,489,200 | 1/1970 | Recchione | 160/133 |
| 4,016,920 | 4/1977 | Shepard | 160/133 |
| 4,467,853 | 8/1984 | Downey | 160/133 |
| 4,586,552 | 5/1986 | Labelle | 160/133 |
| 4,601,320 | 7/1986 | Taylor | 160/133 X |
| 4,974,658 | 12/1990 | Komatsu et al. | 160/133 X |

*Primary Examiner*—David M. Purol

*Attorney, Agent, or Firm*—Sughrue, Mion, Zinn, Macpeak & Seas

[57] ABSTRACT

A raisable-curtain door for closing a door-bay through a wall between two volumes of air maintained at different temperatures includes two vertical side uprights, each of which forms a slideway delimited by two vertical edges and a raisable curtain having side portions that slide in the slideways. Each of the side uprights includes two vertical metal bars forming respective edges of the slideway, which bars are separated from each other so as to define the associated slideway over substantially the entire height of the upright. A first of the vertical bars is located closer to the wall than the second of the vertical bars. The first bar is in draft-proof contact with the wall and in substantially draft-proof contact with the curtain over the entire height of the curtain when the curtain is down.

17 Claims, 6 Drawing Sheets

FIG. 2
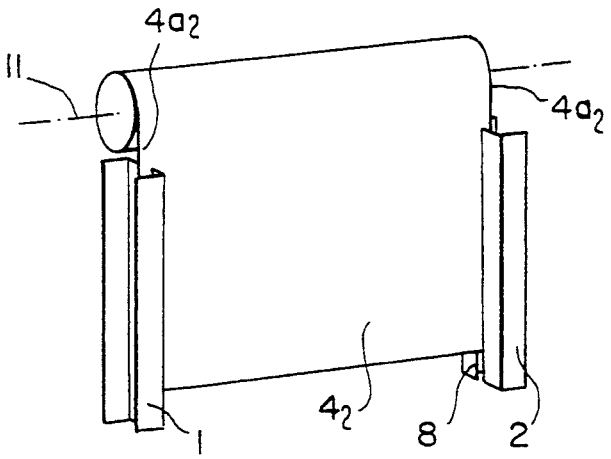
FIG. 4
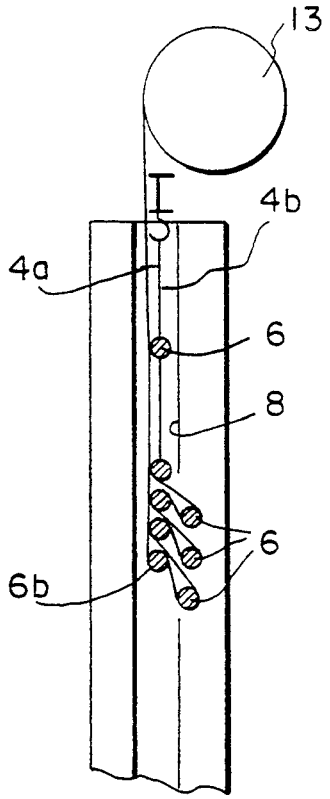
FIG. 5
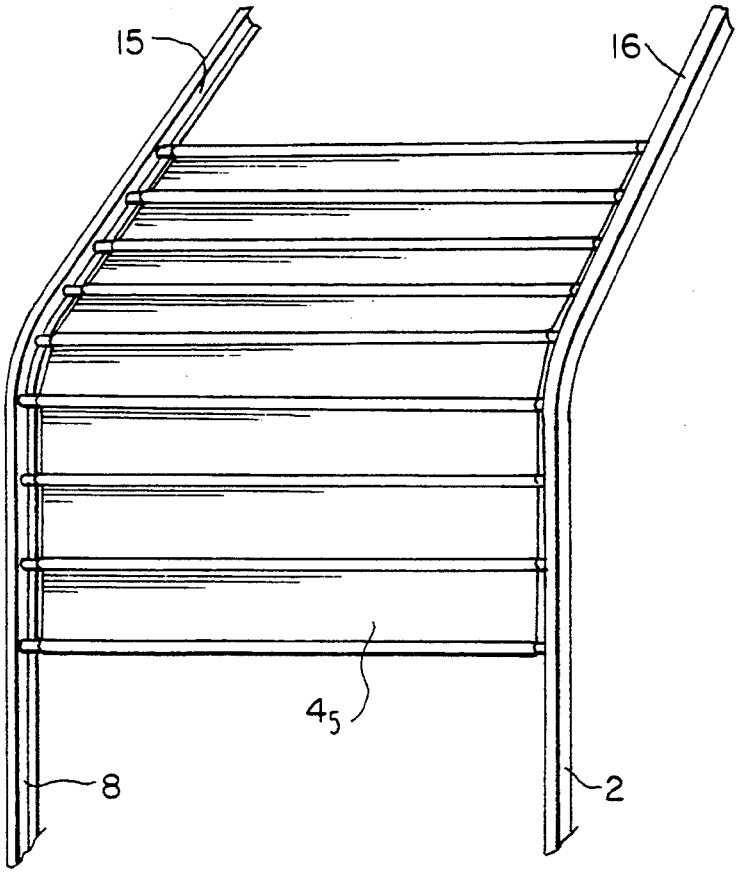
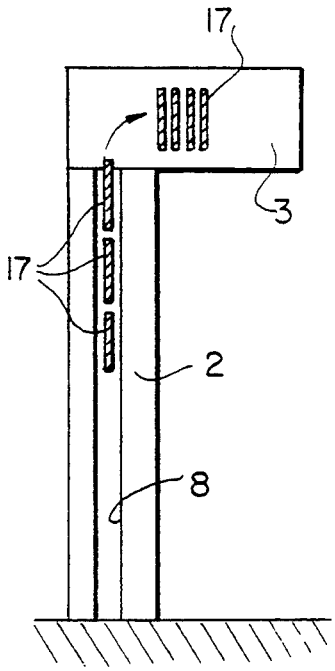
FIG. 6

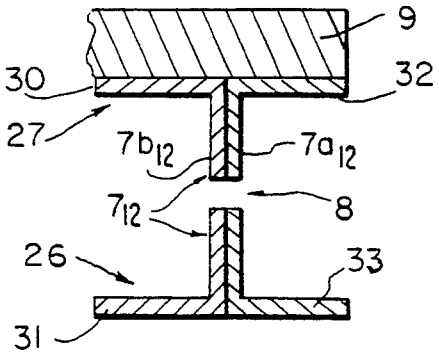
FIG. 12a
FIG. 3
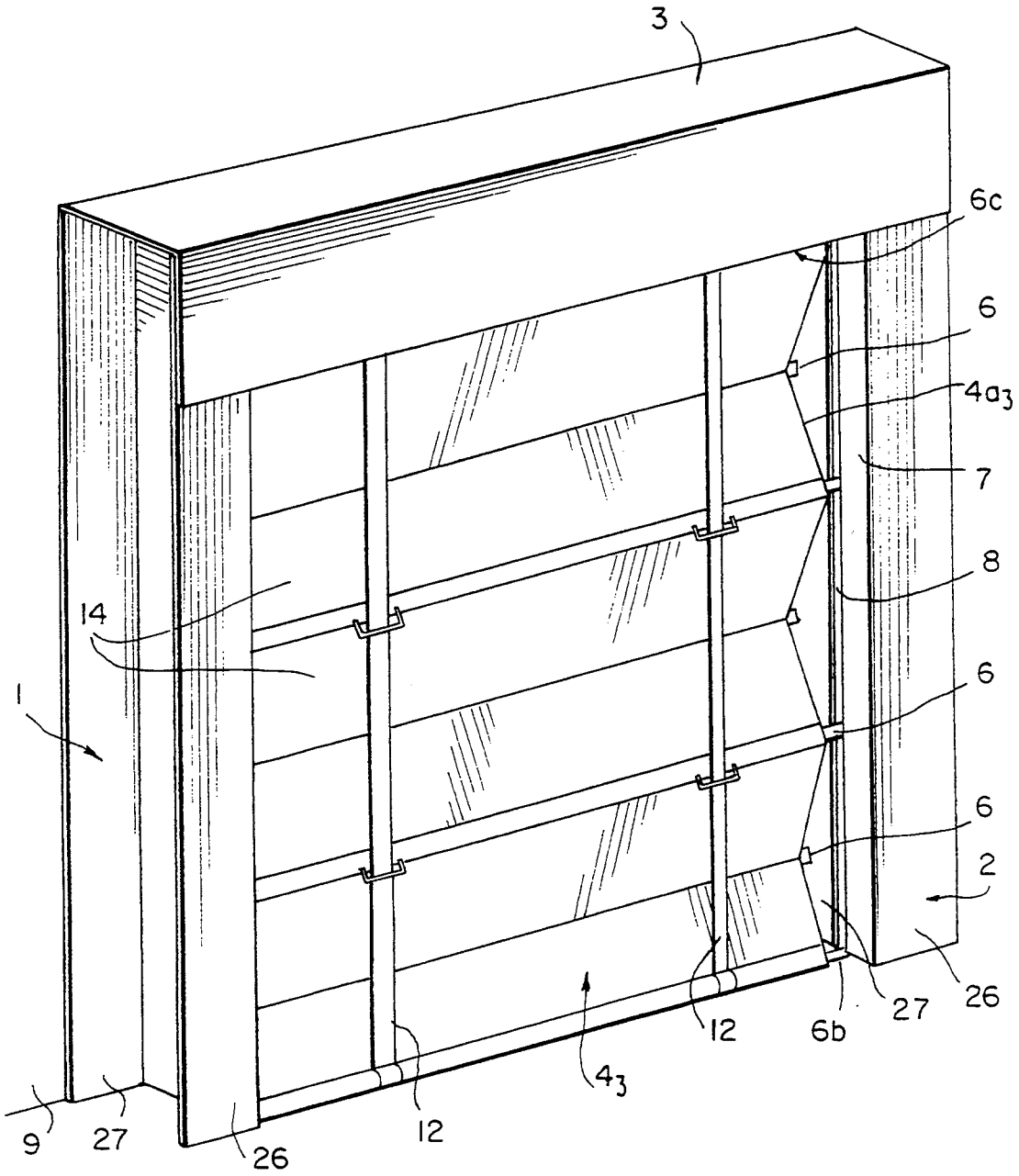

FIG.17
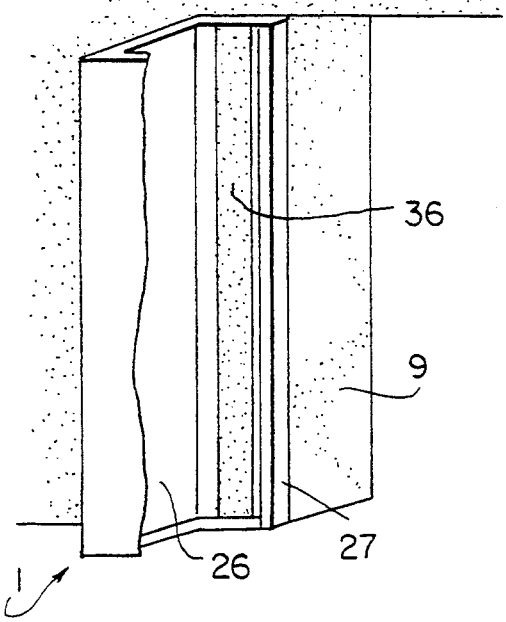
FIG.18
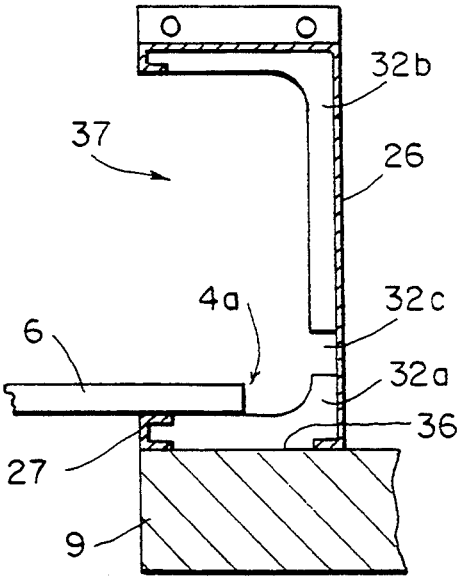
FIG.19
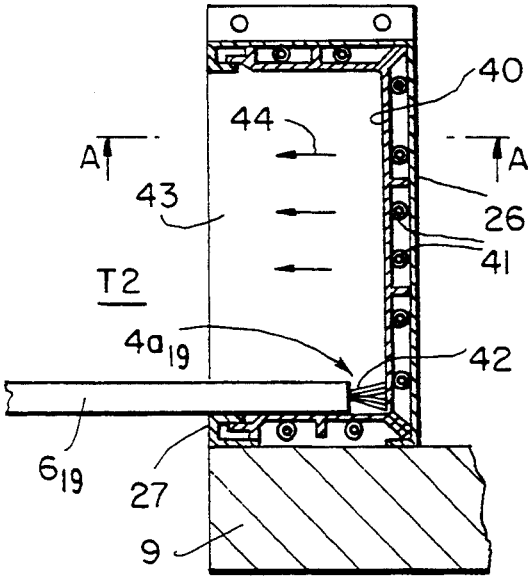
FIG.20
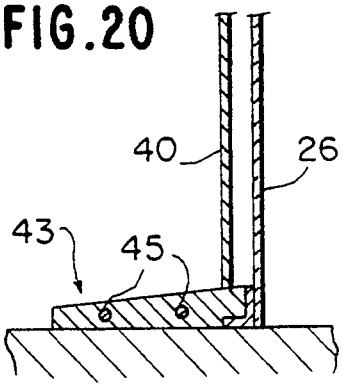
T1
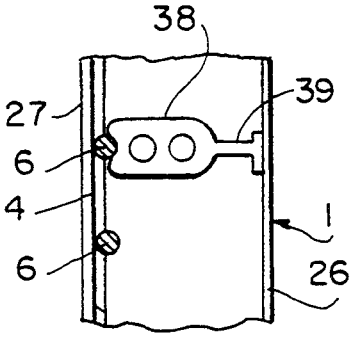
FIG.18a

RAISABLE-CURTAIN DOOR PROVIDING LOW HEAT LOSS

The present invention relates to a raisable-curtain door providing good heat insulation, and designed to be fitted to a door-bay formed through a wall that separates two volumes of air at different temperatures. For example, such a door may be installed in a cold storage warehouse.

BACKGROUND OF THE INVENTION

Raisable-curtain doors generally comprise two side uprights, usually made of metal, and are provided with slideways in which the side portions of the raisable curtain slide.

An object of the present invention is to limit heat losses due to said metal uprights.

SUMMARY OF THE INVENTION

Thus, the present invention provides a raisable-curtain door designed to close a door-bay through a wall between two volumes of air at different temperatures, said door including two vertical side uprights each of which forms a slideway delimited by two vertical edges, said door including a raisable curtain having side portions that slide in said slideways, wherein each side upright includes two vertical metal bars each forming one of vertical edges of the slideway, which bars are separated from each other by a vertical slot extending over substantially the entire height of the upright, at least one of said vertical bars being closer to a wall and being in draft-proof contact with the wall and in substantially draft-proof contact with the curtain over the entire height of the curtain, when said curtain is down. The curtain may be in continuous substantially draft-proof contact over its entire height with said vertical bar that is in draft-proof contact with the wall and/or the door may further include presser members that act when the curtain is down to press the curtain in substantially draft-proof contact against said vertical bar which is in draft-proof contact with the wall.

The vertical bars may be locally connected together by link members. In another embodiment, each side upright includes at least one horizontal metal plate, where the plate is itself constituted by two metal plates which are not in direct contact with each other. One of the two metal plates constitutes one of the link members and is welded to the entire outline of one of the vertical bars and to a short length of the outline of the other one of said vertical bars while the other one of said two plates is welded over substantially all of the remaining length of the outline of the other one of said vertical bars. Advantageously, the pairs of metal plates are cut out substantially to match the outlines of the vertical metal bars, so as to limit heat transfer. Alternatively, metal plates are covered by slabs of thermally insulating material.

In one embodiment, each upright is substantially a channel section member having a web that is substantially perpendicular to the wall and two flanges that project from the web towards the door-bay to be closed. The web and the flanges of the channel section have an internal lining of a thermally insulating material between which the side portions of The curtain slide. One of the flanges of the channel section is in draft-proof contact with the wall and includes the vertical slot between said two bars, such that one of the bars constitutes a portion of said flange that is distant from the web of the channel section, said bar being in substantially draft-proof contact with the curtain over the entire height of the curtain, when the curtain is down. The uprights are disposed on a side of the wall that is in contact with a volume of air at a temperature that is lower than 0° C., while the other side of the wall is in contact with a volume of air that is at a temperature greater than 0° C. Advantageously, the lining is provided with heater means for heating said lining.

In another embodiment, when the door upright includes a metal plate covered by an insulating slab, each upright is a substantially channel section member having a web that is substantially perpendicular to the wall and two flanges that project from the web towards the door-bay to be closed. The web and the flanges of the channel section have an internal lining of a thermally insulating material between which the side portions of the curtain slide. One of the flanges of the channel section is in draft-proof contact with the wall and including said vertical slot between said two bars, such that one of said bars constitutes a portion of said flange that is distant from the web of the channel section, said bar being in substantially draft-proof contact with the curtain over the entire height of the curtain, when the curtain is down. The lining is provided with heater means for heating said lining, and said uprights are disposed on a side of the wall that is in contact with a volume of air at a temperature that is lower than O° C., while the other side of the wall is in contact with a volume of air that is at a temperature greater than O° C., the insulating slab which covers the plate itself includes heater means for heating said insulating slab. If the plate is placed on the ground, it may slope so as to facilitate the flow of water over said insulating slab and out from the channel section.

In another embodiment, each upright is a substantially channel section member having a web that is substantially perpendicular to the wall and two flanges that extend from the web away from the door-bay that is to be closed, said slot being formed in the web and defining said slideway, the inside of the channel section thus being accessible to enable it to be cleaned.

In another embodiment, said upright has a substantially V-shaped section, with the ridge of the V-shape being adjacent to the door-bay and with two diverging arms that extend away from the door-bay from said ridge, said slot being formed in the ridge of the V-shape and constituting said slideway, the inside of the V-shape section thus being accessible to enable it to be cleaned.

In another embodiment, each upright is a substantially channel-section member, with a web that is substantially parallel to the wall and with two flanges that extend away from the web, the closer of said flanges to the door-bay having said slot formed therein to constitute said slideway, the inside of the channel section thus being accessible to enable it to be cleaned.

In the last three embodiments, the slot of each side upright has a lip on either side thereof that extends parallel to the curtain or else is rounded. The flanges of the channel section upright may be reduced horizontal by towards their bottoms.

BRIEF DESCRIPTION OF THE DRAWINGS

Embodiments of the invention are described by way of example with reference to the accompanying drawings, in which:

FIGS. 1*a* to 6 are diagrams showing examples of raisable-curtains in a door of the invention;

FIG. 17 is a partially cutaway perspective view of an upright of the FIG. 16 door;

FIG. 18 is a horizontal section view through the FIG. 17 upright;

FIG. 18*a* shows a detail of the upright shown in FIG. 18;

FIG. 19 is a view similar to FIG. 18, showing a variant embodiment; and

FIG. 20 is a section view on line A—A of FIG. 19. In the various figures, the same references are used to designate items that are the same or similar.

DETAILED DESCRIPTION

Figure 1A:
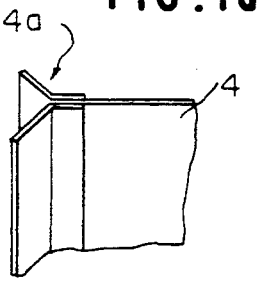
Figure 1:
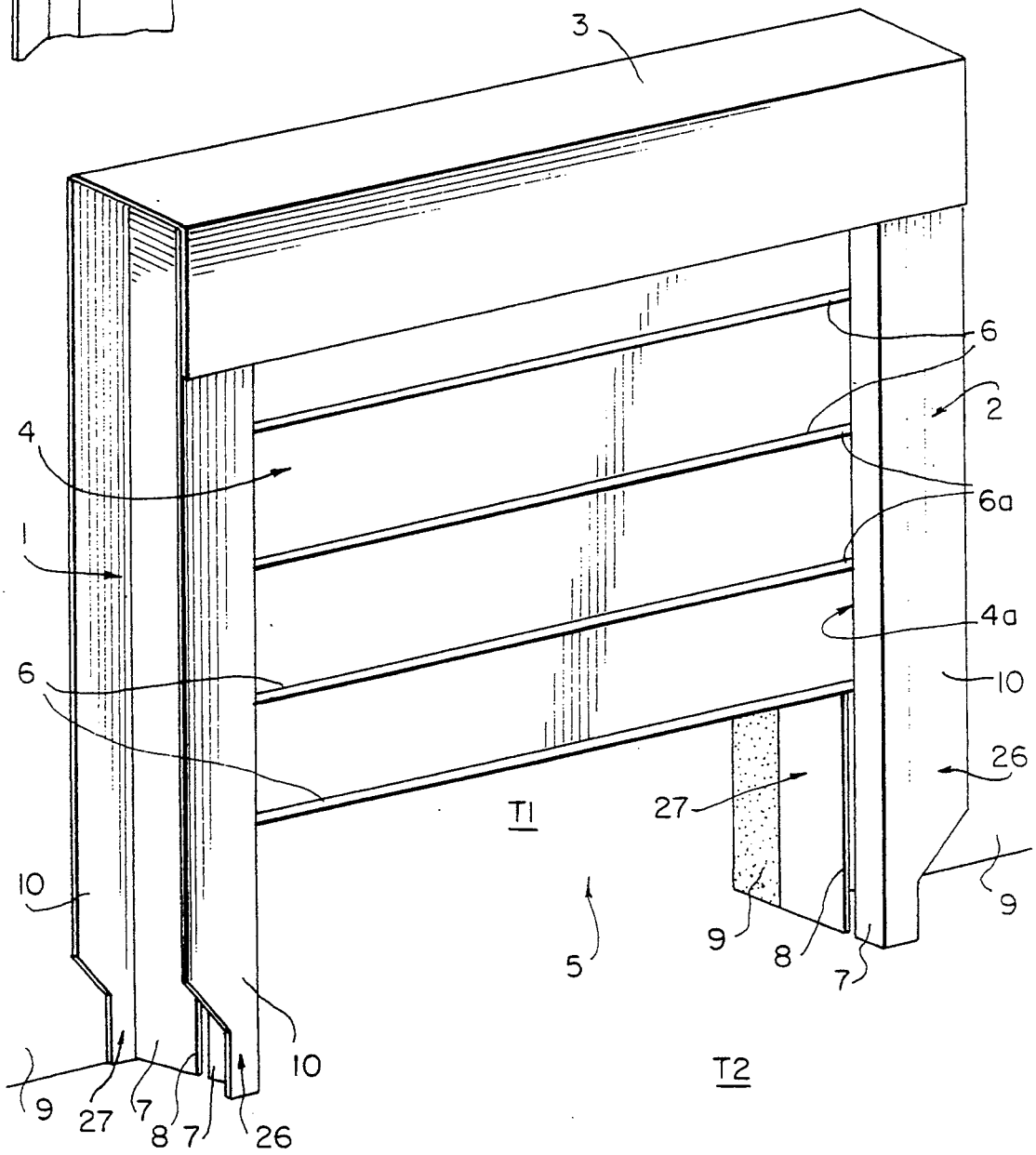
FIG. 1 is a diagrammatic perspective view of a door of the invention.

As shown in FIG. 1, the present invention relates to a door for closing a door-bay 5 in a wall 9 that separates two volumes of air at different temperatures T1 and T2. For example a door of a cold storage warehouse may have T1 equal to +20° C. and T2 equal to −40° C. The door comprises an insulating curtain 4 that is raisable by being wound up, and two side uprights 1 and 2 generally made of metal, each provided with a slideway 8 for guiding the curtain 4. In the example shown in FIG. 1, the side uprights 1 and 2 are interconnected at their top ends by a cross-member 3 which contains the drive mechanism for the curtain, however this feature could be omitted without going beyond the ambit of the present invention. The door shown in FIG. 1 is of a type commonly called a "goods-handling" door, i.e., a door that opens quickly in order to allow goods-handling equipment to pass through, and then closes after the equipment has gone through.

Each side upright 1, 2 includes a front web 7 which is substantially perpendicular to the curtain 4 in this case, and which is provided with a longitudinal slot that forms said slideway 8. It may be observed that the web 7 need not necessarily be perpendicular to the curtain 4: the web 7 needs merely to be locally non-parallel to the curtain 4 in the vicinity of the slideway 8. In the example in FIG. 1, the side uprights 1 and 2 are in the form of channel section members, each having two flanges 10 that project a predetermined distance from said web 7 outwards relative to the door-bay 5. The side uprights may have a section that is equivalent to a channel section, for example they may have an I section or a V section. Each side upright 1, 2 is constituted by a pair of metal angle section bars 26 and 27 leaving the slideway 8 between them. The bar 27 of each of the side uprights is in sealed contact with the wall 9, so as to keep drafts through the door-bay 5 to a minimum.

The curtain 4 includes side portions that slide in the slideways 8 of the uprights 1 and 2. In the particular example of FIG. 1, the curtain 4 is flexible and is raisable by being rolled up, it includes horizontal reinforcing bars 6 with axial ends 6*a* that slide in the slideways 8, and it further includes side edges 4*a* that also slide in the slideways 8. The curtain 4 may optionally not include reinforcing bars 6. If the curtain 4 is liable to be subjected to violent shocks, e.g. from goods-handling vehicles, it may be advantageous for the side portions of the curtain that slide in the slideways 8 to be adapted to escape from said slideways 8 in the events of the curtain 4 is subjected to a violent shock, thereby avoiding damage to the curtain itself. Solutions to that problem are given in the following documents: EP-A-0 398 791; EP-A-0 320 350; GB-A-1 597 396; EP-A-0 264 220; and EP-A-0 272 733. In the example shown, the slideway 8 are fairly narrow such that the side portions of the curtain slide in said slideways 8 with little clearance, thereby establishing substantially draft-proof contact with the front web 7 on either side of the slideway 8 and thus keeping drafts through the door-bay 5 to a minimum. Draft-proofing between the side edges 4*a* of the curtain and the uprights 1 and 2 may be improved by using side edges that are thick, e.g., as shown in FIG. 1*a*. In FIG. 1*a*, the side edge 4*a* of the curtain is provided with two strips of resilient flexible material that are fixed to the curtain 4 and that flare in a V-shape away from the curtain. When the curtain slides in the slideways 8 of the uprights 1 and 2, the divergent arms of the V-shapes bear elastically against the front web 7 on either side of the slideways 8, thereby providing excellent draft-proofing. The V-shaped flexible strips may be replaced by thickenings that are advantageously hollow and that form the side edges of the curtain 4.

The door of the invention may be actuated by mechanical or electromechanical means that are well known in the art. The curtain generally denoted 4 may be raised in various different ways and it may be made in various different manners without going beyond the scope of the present invention, providing that it includes side portions that slide in the slideways 8. FIGS. 2 to 6 give various non-limiting examples for explaining various ways in which the curtain may be raised.

As shown diagrammatically in FIG. 2, the curtain $4_2$ may be flexible and it may roll up onto a horizontal shaft 11 at the top of the door. In the particular example of FIG. 2, the curtain $4_2$ has side edges $4_2$ (thickened or otherwise) that slide in the slideways 8 of the side uprights 1 and 2. As mentioned above, the curtain $4_2$ may also include horizontal reinforcing bars whose ends slide (or not) in the slideways 8.

In another example shown diagrammatically in FIG. 3, the curtain $4_3$ may fold up, concertina-like. In the particular example of FIG. 3, the curtain $4_3$ is constituted by rigid panels 14 that are hinged to horizontal reinforcing bars $6_3$, with every other reinforcing bar sliding in the slideways 8 of the uprights 1 and 2. The door also includes vertical straps $12_3$ attached to the bottom reinforcing bar $6b_3$ and suitable for being wound onto a horizontal shaft (not shown) at the top of the door. The top reinforcing door $6c_3$ (not visible in FIG. 3) is secured to prevent it moving down when the curtain $4_3$ is lowered into its closed position. By winding up the strap $12_3$ the bottom bar $6b_3$ is raised, and in turn it entrains the other reinforcing bars $6_3$ which slide along the slideways 8 with the curtain $4_3$ folding up concertina-like. The rigid panels 14 may be panels that are distinct and hinged on the bars $6_3$, or they may be constituted by a single flexible fabric or sheet of flexible material that is common to the entire curtain $4_3$ and that is tensioned by spacers between the bars $6_3$.

In another example as shown diagrammatically in FIG. 4, the curtain $4_4$ is constituted by a flexible sheet provided with horizontal reinforcing bars $6_4$, with every other reinforcing bar sliding in the slideways 8 of the uprights 1 and 2. As in the example of FIG. 3, the bottom bar $6b_4$ is connected to straps $1_4$ that wind onto a shaft 13 at the top of the door. Winding the straps $12_4$ up onto the shaft 13 causes the bottom bar $6b_4$ to be raised, and in turn causes it to entrain the other reinforcing bars $6_4$ which slide in the slideway 8, folding up the curtain $4_4$ concertina-like. Naturally, the top portion $4b_4$ of the curtain $4_4$ is secured so that it does not move down when the curtain $4_4$ is lowered into its closed position. In this example, it may be observed that it would also be possible for all of the reinforcing bars 6 to slide in the slideways 8.

In the examples of FIGS. 3 and 4, it is desirable for the side edge $4a_3$, $4a_4$ of the curtain to be very close to the front web 7 of the angle bar 27 adjacent to the wall 9 so as to ensure that the side edge 4a is in substantially draft-proof contact with the bar 27, at least when the curtain is down, so as to minimize the flow of air through the door-bay 5. Advantageously, the edge $4a_3$, $4a_4$ of the curtain may include a strip of flexible material such as a strip of rubber that may optionally be split width-wise, and bearing resiliently against the wall-engaging web 7 in the vicinity the bar 27. Examples of flexible curtain strips are given in the Applicants' Document EP-A-0 194 494 and in corresponding U.S. Pat. No. 4, 934, 437.

There are other ways in which the curtain 4 can be implemented. For example, as shown in FIG. 5, it may be raisable without being folded concertina-like and without being rolled up, but merely by being moved upwards in translation, possibly at an angle sloping relative to the vertical. In FIG. 5, the uprights 1 and 2 are thus extended by sloping slideways 15 and 16. The curtain $4_5$ can then be flexible, optionally reinforced by horizontal reinforcing bars, $6_5$ or else it may be constituted by rigid panels that are hinged together etc. If the guiding slideways 15 and 16 are in alignment with the side uprights 1 and 2,the curtain $4_5$ may even be constituted by a single rigid panel.

In another variant, the curtain $4_6$ may be constituted by independent rigid panels 17 which are stacked in the horizontal portion of the door when the curtain $4_4$ is raised, as shown in FIG. 6.

Figure 7:
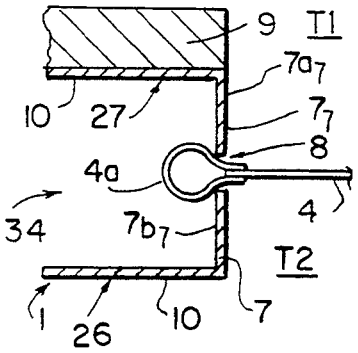
FIGS. 7 to 13 are horizontal section views through various embodiments of uprights for a door of the invention.

FIG. 7 shows the upright 1 of FIG. 1 together with a curtain 4 having a thickened edge 4a which slides in the slideway 8, separating two volumes of air at different temperatures T1 and T2. Because there is a gap 34 between the two flanges $10_7$ of the channel section, i.e. between the two angle bars 26 and 27, the only heat exchange that is possible between the two masses of air at temperatures T1 and T2 takes place by conduction through the angle bar 27, there being no fin effect since one side of the bar 27 is in contact with the wall 9 and with the mass of air at T2, while its other side is in contact with the mass of air at Ti: Heat is thus exchanged through an area that is much smaller than in the prior art where the upright generally includes a rear wall that replaces the gap 34 such that the upright forms a heat-dissipating fin.

In addition, the channel section of the upright shown in FIGS. 1 and 7 makes it easy to clean substantially all of the upright. This is very important in any premises where strict hygiene is required, for example cold storage warehouses for food, pharmaceutical laboratories, etc. In particular, the front web 7 which is in the door-bay 5 and which is therefore liable to come into contact with objects or people passing through the door-bay 5 can be cleaned on beth faces: it can be cleaned on a first face *7a* looking towards the curtain $4_5$ and also on an opposite second face *7b* facing away from the curtain $4_3$, because both of its faces are easily accessible. The face *7b* is accessible via the gap 34 in the upright between its two flanges 10. The angle bars 26, 27 of the uprights 1 and 2 can be cleaned on both faces. The channel-sections of the uprights give them good mechanical strength, as, indeed, would other section shapes.

It will be noted that, the flanges 10 of each upright may include respective bottom notches for facilitating cleaning by means of a lance.

Figure 8:
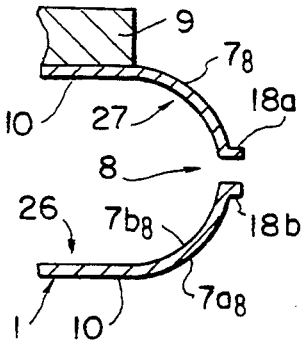

The uprights 1 and 2 may have sections other than a channel section with plane walls. For example, FIG. 8 shows a variant of the FIG. 7 upright which is still generally channel section in shape, but which now has a front web $7_8$ that is rounded. In addition, in the example of FIG. 8, the web $7_8$ has two lips 18*a* and 18*b* running along the sides of the slideway 8. These lips 18*a* and 18*b* extend up the entire height of the slideway 8 and they project a short distance horizontally parallel to the curtain $4_6$, either towards or away from the said curtain. Such lips may be advantageous in some cases for avoiding damage due to localized rubbing on the side portions that slide in the slideway 8 of the side uprights. They are small in width so as to be easily cleaned.

Figure 9:
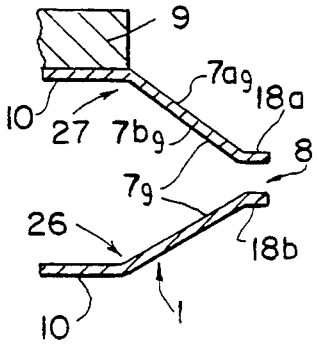

FIG. 9 shows a variant of the FIG. 8 section, but this time the web $7_9$ is V-shaped.

Figure 10:
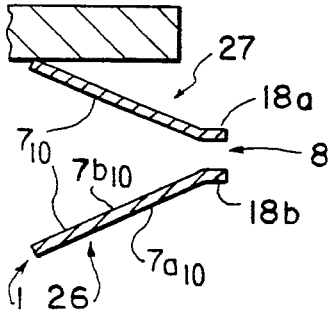
Figure 11:
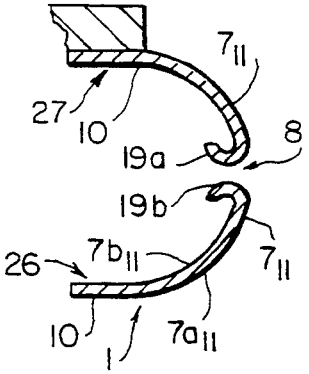

FIG. 10 shows another variant in which the side uprights are constituted solely by a V-shaped web $7_{10}$. FIG. 11 shows a variant of FIG. 8 in which the plane lips 18*a* and 18*b* are replaced by rounded portions 19*a* and 19*b*. It may also be observed that in general the longitudinal side edges of the slideway 8 may be provided with a protective coating, e.g. an anti-friction coating, without going beyond the ambit of the present invention.

Figure 12:
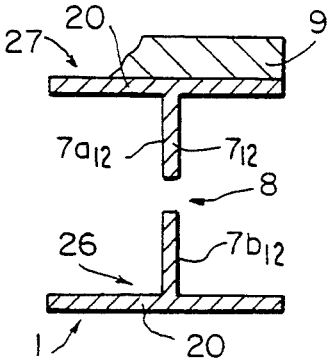

In the example of FIG. 12, the side upright has an I section in which the web 7 having the slideways 8 extends between two pairs of flanges 20 that extend parallel to the curtain, with the flanges 20 projecting both towards the curtain 4 and away from the door-bay 5 from the web 7. Such an I-section upright may optionally be built up from two channel-section bars or from four angle section bars 30, 31, 32, and 33, as shown in FIG. 12*a*.

Figure 13:
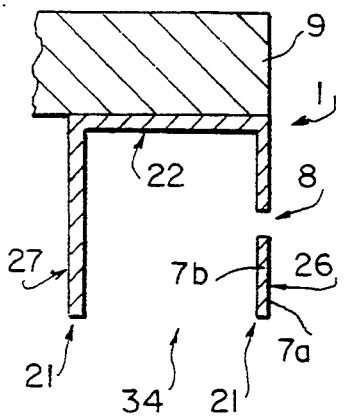

In another variant, shown in FIG. 13, the section of the side uprights 1 and 2 is a channel section, having a web 22 and two flanges 21, but in this case the slideway 8 is formed through one of the flanges 21 of the channel section.

It may be observed that the sections of the uprights in FIGS. 7 to 13 may advantageously be used even when the door separates two masses of air at temperatures that are identical or close, but in premises where strict hygiene is required. Under such circumstances, it is not absolutely necessary to have draft-proof contact between the uprights and the wall around the door-bay, or between the curtain and the uprights, unless there are other reasons for preventing drafts (premises that are sterile, or dust-free, or at a pressure other than ambient,. . .).

In the embodiment of FIG. 12*a*, the two angle bars 32 and 33 closest to the curtain may optionally be made of plastic, while the other two angle bars 30 and 31 are made of steel. This helps the curtain to slide and limits the damage caused by goods-handling machinery striking the uprights, while also limiting heat exchange.

Figure 14:
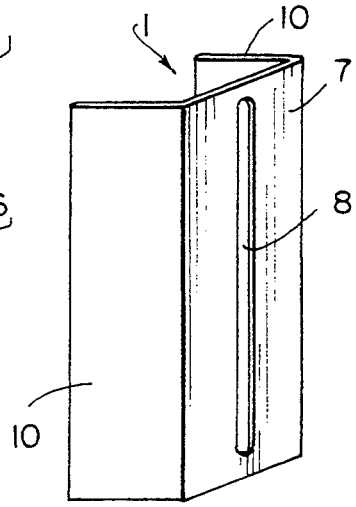
FIGS. 14 and 15 show two ways in which the uprights of FIG. 7 may be manufactured.

The uprights 1 and 2 may alternatively be constituted by respective single pieces, as shown in FIG. 14, in which case the slideway 8 is cut through the front web 7. The slideway 8 may optionally open out into the top of the web 7, e.g., if the curtain 4 is raised by being rolled onto a shaft, however the slideway 8 need not open out to the top of the web 7, as shown in FIG. 14, e.g., when the curtain 4 is raised by being folded up concertina-like. In the embodiment of FIG. 14, the upright has two flanges 10 parallel to the curtain 4: these flanges 10 may optionally be connected together by spacers in order to reinforce the upright.

Figure 15:
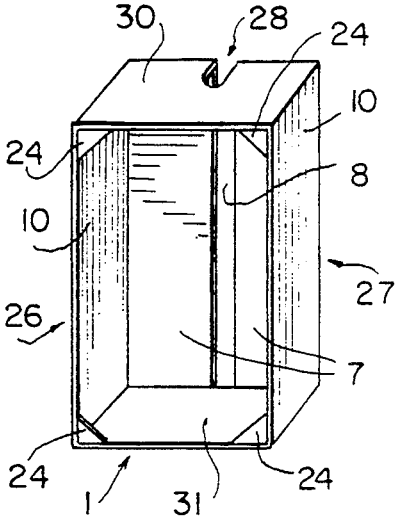

The side uprights 1 and 2 may also be made by assembling together two parts 26 and 27, each of which defines one of the longitudinal edges of the slideway 8. In the example of FIG. 15, the two parts 26 and 27 are angle section bars that are assembled together by horizontal spacer plates 30 and 31, optionally in association with angle reinforcements 24. The top plate 31 may optionally include a notch 28 coinciding with the slideway 8 and enabling said slideway 8 to open out to the top of the upright. The plates 30 and 31 may be welded, riveted, bolted, or fixed in place by any other means. The plates 30 and 31 may optionally be made in two portions, as shown in FIG. 18.

Figure 16:
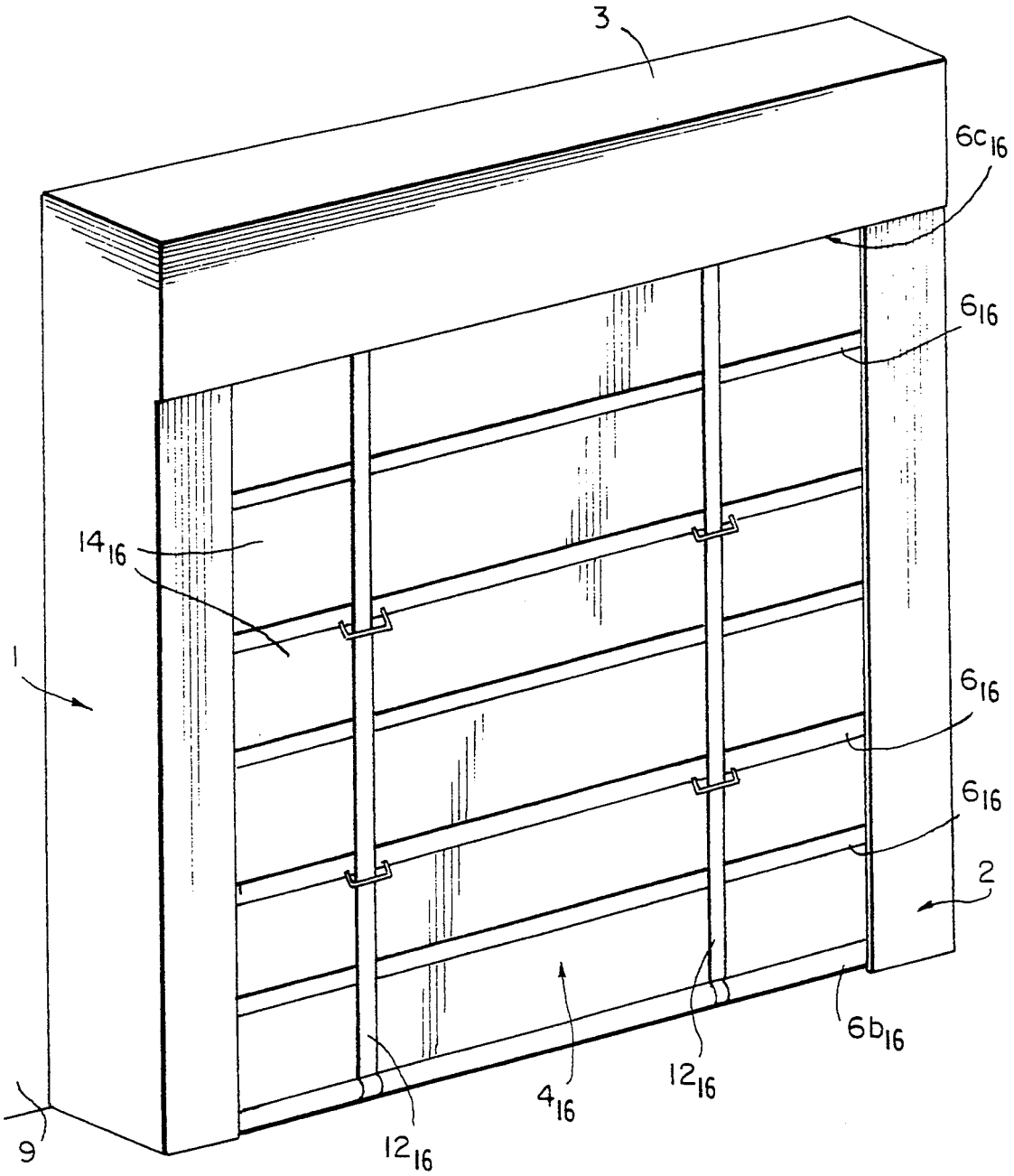
FIG. 16 is a perspective view of another embodiment of the door of the invention.

FIG. 16 shows another variant of the invention in which the curtain is raised by being folded up concertina-like as in FIGS. 3 and 4, but in which the side uprights are channel section members having their flanges facing towards the inside of the door-bay 5. One of the flanges is in draft-proof contact with the wall 9, and as can be seen in FIGS. 17 and 18, said channel section flange has a vertical aperture 36 extending over its entire height and splitting the upright into two bars, as described above. When the curtain 4 is down, it is pressed with substantially draft-proof contact against the bar 27 by a presser member 38 such as the member shown in FIG. 18*a* which is in the form of an elongate body of plastic mounted by means of a plastic hinge 39 on the bar 26. Such a presser member is described in greater detail in the Applicants' Document EP-A-0 416 961 or in the corresponding US patent U.S. Pat. No. 5 095 964.

Other presser members may be designed.

The edge denotes of the curtain could optionally include flexible strips that rub against the web of the channel section member, as shown in FIG. 19, and as described in the Applicant' Document EP-A-O 194 194 and in the corresponding patent U.S. Pat. No. 4 934 437.

Advantageously, the tops or the bottoms of the bars 26 end 27 include pairs of plates that are not in direct contact with each other. FIG. 18 shows the bottom pair 32 of plates 32*a*and 33*b* that stand on the ground and that are separated from each other by an opening 22*c*. The plate 32*a* is welded to the bar 27 around the entire outline of said bar, and to the bar 26 over a short length of the outline of the bar 26. The plate 32*b* is welded to the remaining length of the outline of the bar 26. The plates 32*a* and 32*b* are cut out so that their outlines substantially match those of the bars 26 and 27, thereby making it possible to minimize the dimensions of said plates for the purpose of limiting heat exchange. The plate 32*a* constitutes a linking member between the two bars 26 and 27. Because of the slot 32*c* and because of the narrow width of the plate 22*a*, said plate constitutes a very restricted thermal bridge between the bars 26 and 27. The plate 32*b* serves to stiffen the bar 26, and to improve its contact with the ground.

FIGS. 19 and 20 show a variant of the FIG. 18 upright which is intended more particularly for the case where said upright is situated on one side of a wall 9 which is at a temperature T1 below 0° C. while the other side of the wall 9 is at a temperature T1 that is above 0° C. In this variant, the inside of the channel section of the upright is covered with an insulating lining 40 for the particular purpose of preventing the formation of frost. The lining 40 may advantageously be provided with heater means, e.g., such as resistive electric wires 41. A description of an existing version of such a lining together with its heater means is to be found, for example, in the Applicants' Document EP-A-0 220 096 and in the corresponding US patent U.S. Pat. No.4,776,379. Advantageously, the side edges 4a of the curtain are provided with flexible insulating strips 42, e.g., made of rubber that rub against the web of the channel section of the upright: such insulating strips are described in greater detail in the Applicants' Document EP-A-0 194 194 and in the corresponding US patent U.S. Pat. No. 4, 934,437. In the embodiment of FIGS. 19 and 20, the upright could optionally omit the presser member 38, with the curtain generally denoted 4 being kept in draft-proof contact against the bar 27 by the flexible strips 42 and the insulating lining 40.

Advantageously, at least the bottom plate 31 is covered by an insulating slab 43 which slopes towards the outside of the channel section, i.e., into the door-bay 5, as represented by arrows 44 in FIG. 19, thereby ensuring that any condensation or defrosting water or any cleaning water that may be found inside the upright flows out therefrom. Advantageously, the slab 43 has heater means 45, e.g., heating electrical resistances embedded in the slab 43 if it is made of plastic: this prevents frost forming on the slab 43.

In the above description and in the following claims, mention is made solely of a raisable-curtain door, however the invention is also applicable to horizontal slideways for doors that have a curtain which is displaceable horizontally.

I claim:

1. A raisable-curtain door for closing a door-bay through a wall separating two volumes of air at different respective temperatures, said door comprising:

two vertical side uprights each of which forms a slideway delimited by two vertical edges; and a raisable curtain having side portions that slide in said slideways, wherein each side upright includes vertical metal first and second bars each forming one of the vertical edges of the respective one of the slideways, said first and second bars in each of said side uprights being separated from each other so as to define a respective slideway extending over substantially the entire height of each said side upright, wherein said first bar is disposed a predetermined distance from said wall and said second bar is disposed in draft-proof contact with the wall, and wherein said second bar is in substantially draft-proof contact with said curtain over the entire height of the curtain, when said curtain is down.

2. The raisable-curtain door according to claim 1, wherein said curtain is in continuous, substantially draft-proof, contact over its entire height with said second bar, said second bar being in draft-proof contact with the wall.

3. The raisable-curtain door according to claim 1, wherein each upright comprises a member having a substantially channel-shaped cross sectional area, said member including:

a web portion which is disposed substantially perpendicular to the wall; and first and second flange portions which extend from the web portion away from the door-bay, wherein said slideway is formed in said web, and wherein said member includes inside and outside surfaces, both of which are accessible so as to permit cleaning.

4. The raisable-curtain door according to claim 3, wherein each of said side uprights comprises a lip extending substantially parallel with respect to said slideway and parallel to the curtain.

5. The raisable-curtain door according to claim 3, wherein each of said side uprights comprises a pair of lips having rounded edges, each of said lips extending substantially parallel to said slideway.

6. The raisable-curtain door according to claim 1, wherein each of said uprights comprises:

a member having a substantially V-shaped cross-sectional area having a ridge adjacent to the door-bay and having two diverging arms that extend away from the door-bay from said ridge, wherein said slideway is formed in the ridge, and wherein said member further comprises an inside and an outside surface both of which are accessible so as to permit cleaning.

7. The raisable-curtain door according to claim 1, wherein each of said side uprights comprises:

a member having a substantially channel-shaped cross-sectional area member, and further comprising:

a web portion disposed substantially parallel to the wall; and two flange portions extending away from said web portion, wherein one of said flange portions located proximate to said door includes said slideway, and wherein said member further comprising inside and outside surfaces both of said surfaces being accessible so as to permit cleaning.

8. The raisable-curtain door according to claim 1, further including presser members that act when the curtain is down to press the curtain into substantially draft-proof contact against said vertical bar, which is in draft-proof contact with the wall.

9. The raisable-curtain door according to claim 1, wherein said vertical bars of each side upright are locally connected together by link members.

10. The raisable-curtain door according to claim 9, wherein each side upright includes at least one horizontal metal plate, and wherein said plate is itself constituted by two metal plates which are not in direct contact with each other, one of said two metal plates constituting one of said link members and is welded to the entire outline of a respective one of said vertical bars and to a short length of the outline of the other one of said vertical bars while the other one of said two plates is welded over substantially all of the remaining length of the outline of the other one of said vertical bars.

11. The raisable-curtain door according to claim 10, wherein said pairs of metal plates are cut out substantially to match the outlines of the vertical metal bars, so as to limit heat exchange.

12. The raisable-curtain door according to claim 10, wherein said metal plates are covered by slabs of thermally insulating material.

13. The raisable-curtain door according to claim 1, wherein each upright is a substantially channel section member having a web that is substantially perpendicular to the wall and two flanges that project from the web towards the door-bay to be closed, wherein the web and the flanges of the channel section have an internal lining of a thermally insulating material between which said side portions of the curtain slide, one of the flanges of the channel section is in draft-proof contact with the wall, and including said vertical slot between said two bars, such that one of said bars constitutes a portion of said flange that is distant from the web of the channel section, that one of said bars is in substantially draft-proof contact with the curtain over the entire height of the curtain, and wherein each of said uprights is disposed on a side of the wall that is in contact with a volume of air at a temperature that is lower than 0° C., while the other side of the wall is in contact with a volume of air that is at a temperature greater than 0°.

14. The raisable-curtain door according to claim 13, wherein said lining is provided with heater means for heating said lining.

15. The raisable-curtain door according to claim 1, wherein each upright is a substantially channel section member having a web that is substantially perpendicular to the wall and two flanges that project from the web towards the door-bar to be closed, wherein the web and the flanges of the channel section include an internal lining of a thermally insulating material between which said side portions of the curtain slide, one of the flanges of the channel section is in draft-proof contact with the wall, and including said vertical slot between said two bars, such that one of said bars constitutes a portion of said flange that is distant from the web of the channel section, that one of said bars is in substantially draft-proof contact with the curtain over the entire height of the curtain, wherein said lining is provided with heater means for heating said lining, and wherein each of said uprights is disposed on a side of the wall that is in contact with a volume of air at a temperature that is lower than 0° C., while the other side of the wall is in contact with a volume of air that is at a temperature greater than 0° C., and said insulating slab which covers said plate itself including heater means for heating said insulating slab.

16. The raisable-curtain door according to claim 15, wherein said plate is disposed on the ground and said insulating slab slopes so as to facilitate the flow of water over said insulating slab and out from the channel section.

17. The raisable-curtain door according to claim 1, wherein each upright comprises a member having a substantially channel-shaped cross sectional area, said member including:

a web portion which is disposed substantially perpendicular to the wall; and first and second flange portions which extend from the web portion, wherein the flanges of the channel section said each upright are reduced in horizontal extent towards the bottoms of the uprights.

* * * * *